US006758447B2

(12) United States Patent
Tinsley

(10) Patent No.: US 6,758,447 B2
(45) Date of Patent: Jul. 6, 2004

(54) EPIDURAL STABILIZATION DEVICE

(76) Inventor: Ronald E. Tinsley, 2944 Adams St., Eugene, OR (US) 97405

( * ) Notice: Subject to any disclaimer, the term of this patent is extended or adjusted under 35 U.S.C. 154(b) by 297 days.

(21) Appl. No.: 09/905,446

(22) Filed: Jul. 13, 2001

(65) Prior Publication Data

US 2002/0100846 A1 Aug. 1, 2002

Related U.S. Application Data

(63) Continuation of application No. 29/136,449, filed on Jan. 30, 2001, now Pat. No. Des. 455,495.

(51) Int. Cl.[7] ..... B68G 5/00
(52) U.S. Cl. ..... 248/118
(58) Field of Search ..... 248/125.8, 122.1, 248/118; 297/195.11, 344.14, 392, 423.11; D24/185, 183, 184; D6/367; D5/621, 624, 630, 601, 648; 606/240; 601/98, 49; 128/845

(56) References Cited

U.S. PATENT DOCUMENTS 4,662,361 A * 5/1987 Patterson ..... 601/24
4,746,167 A * 5/1988 Palmer et al. ..... 297/423.12
4,943,117 A * 7/1990 Brown ..... 297/392
5,401,078 A * 3/1995 Riach ..... 297/423.11
5,487,590 A * 1/1996 Haynes ..... 297/344.14
D369,691 S * 5/1996 Haynes ..... D6/367
5,762,402 A * 6/1998 Gillotti ..... 297/423.11
5,971,485 A * 10/1999 Clark ..... 297/426.12
6,065,808 A 5/2000 Tinsley
6,273,865 B1 * 8/2001 Perez ..... 601/49
2002/0067060 A1 * 6/2002 Lloyd ..... 297/195.11

* cited by examiner

*Primary Examiner*—Leslie A. Braun
*Assistant Examiner*—Kofi Schulterbrandt
(74) *Attorney, Agent, or Firm*—Robert E. Howard

(57) ABSTRACT

An epidural stabilization device for restraining a sitting patient against movement during an epidural procedure. The device includes an adjustable face cradle, an adjustable chest support, and an arm support. The face cradle, chest support and arm support are attached to a support post. A support leg extends downwardly from the support post. The support leg is preferably adapted to be received and held by a conventional IV clamp attached to an operating or examination table.

2 Claims, 4 Drawing Sheets

EPIDURAL STABILIZATION DEVICE

CROSS-REFERENCE TO RELATED APPLICATIONS

This is a continuation of application Ser. No. 29/136,449, filed Jan. 30, 2001 now Des. 455,495.

BACKGROUND OF THE INVENTION

This invention relates to a device for stabilizing a patient against involuntary movement during an epidural procedure.

Epidural anesthesia or analgesia is one of the most widely used regional anesthetic procedures employed for surgery, obstetrics, postoperative analgesia, and chronic back pain management. In such epidural procedures, anesthetic or analgesic drugs are delivered to the spinal cord by placing the drugs outside of the membranous sac containing the spinal cord using a syringe.

Most often the patient is stabilized against movement by positioning him or her face down on an operating or examination table. However, some patients, such as pregnant women, cannot lie face down on a table, and the epidural procedure must be performed while they are in a sitting position. In such a position patients are not stabilized against movement, and any movement during the epidural procedure can have adverse consequences.

SUMMARY OF THE INVENTION

The present invention is an epidural stabilization device for restraining a sitting patient against movement during an epidural procedure.

The epidural stabilization device includes an adjustable face cradle, an adjustable chest support, and an arm support.

The face cradle, chest support and arm support are attached to a support post.

A support leg extends downwardly from the support post and, preferably, is adapted to be received and held by an IV clamp of the type normally attached to an operating or examination table.

BRIEF DESCRIPTION OF THE DRAWINGS

FIG. 6 is a top plan view there of; and

DESCRIPTION OF PREFERRED EMBODIMENTS

Figure 1:
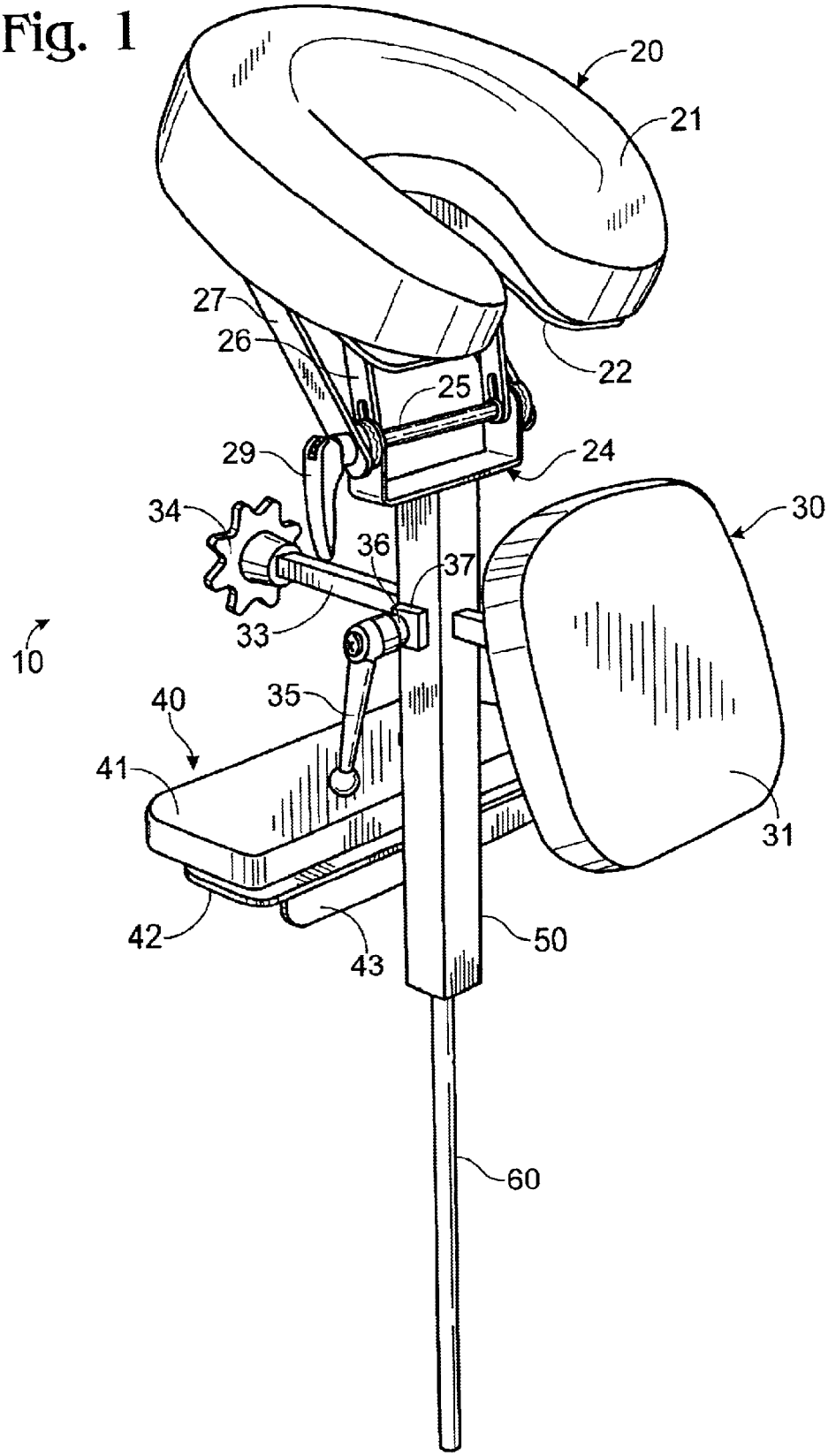
FIG. 1 is a rear side elevational view of the epidural stabilization device of the present invention.
Figure 2:
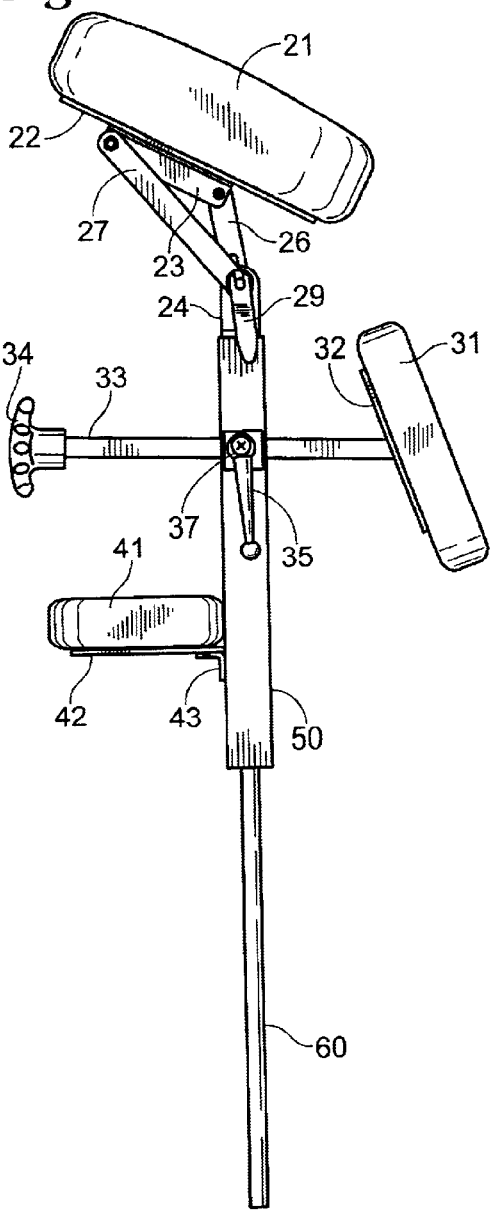
FIG. 2 is a left side elevational view thereof.
Figure 3:
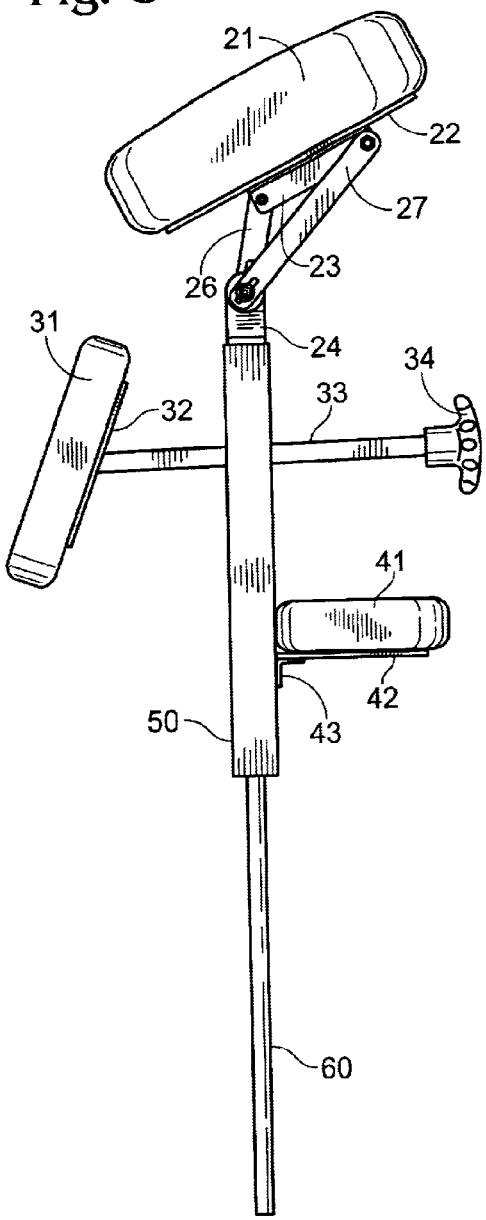
FIG. 3 is a right side elevational view thereof.

The epidural stabilization device 10 of the present invention includes a face cradle subassembly 20, a chest support subassembly 30, an arm support subassembly 40, a support post 50 and a support leg 60.

Face cradle subassembly 20 includes a generally inverted U-shaped face pad 21, open at the bottom thereof. Face pad 21 is formed of a foamed plastic or rubber core with an impervious, cleanable plastic cover. Face pad 21 has substantially parallel upper and lower surfaces, and has a "major plane" passing through the middle thereof that is substantially parallel to the upper and lower surfaces.

Figure 4:
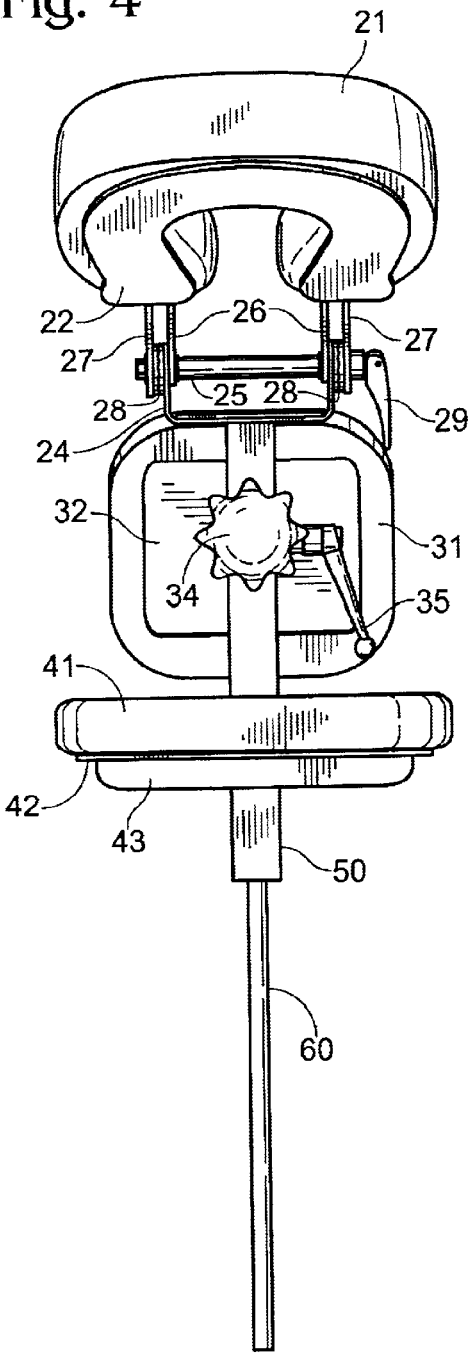
FIG. 4 is a front elevational view thereof.
Figure 5:
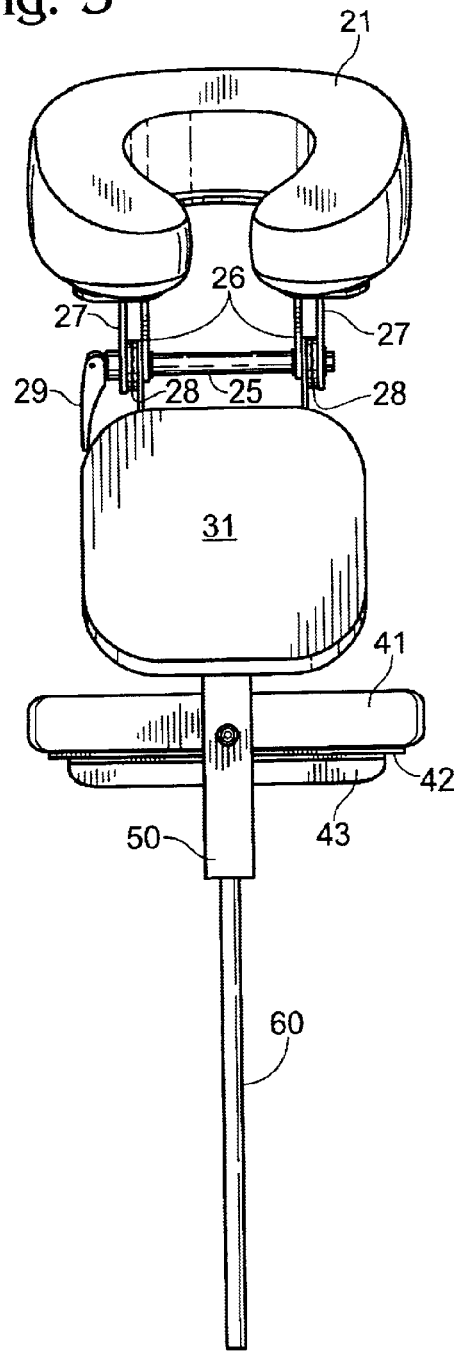
FIG. 5 is a rear elevational view thereof.
Figure 6:
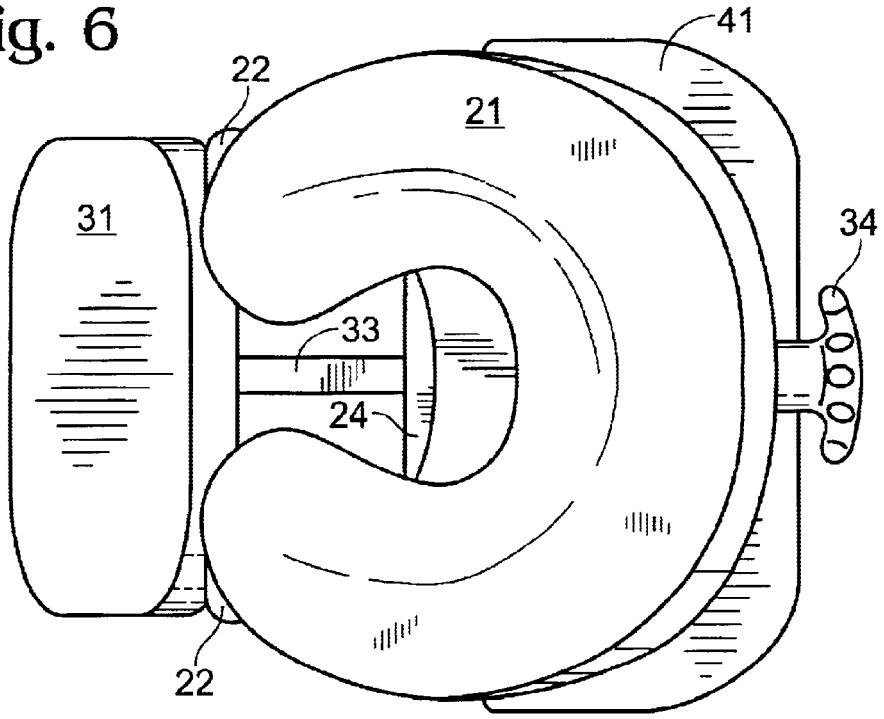
Figure 7:
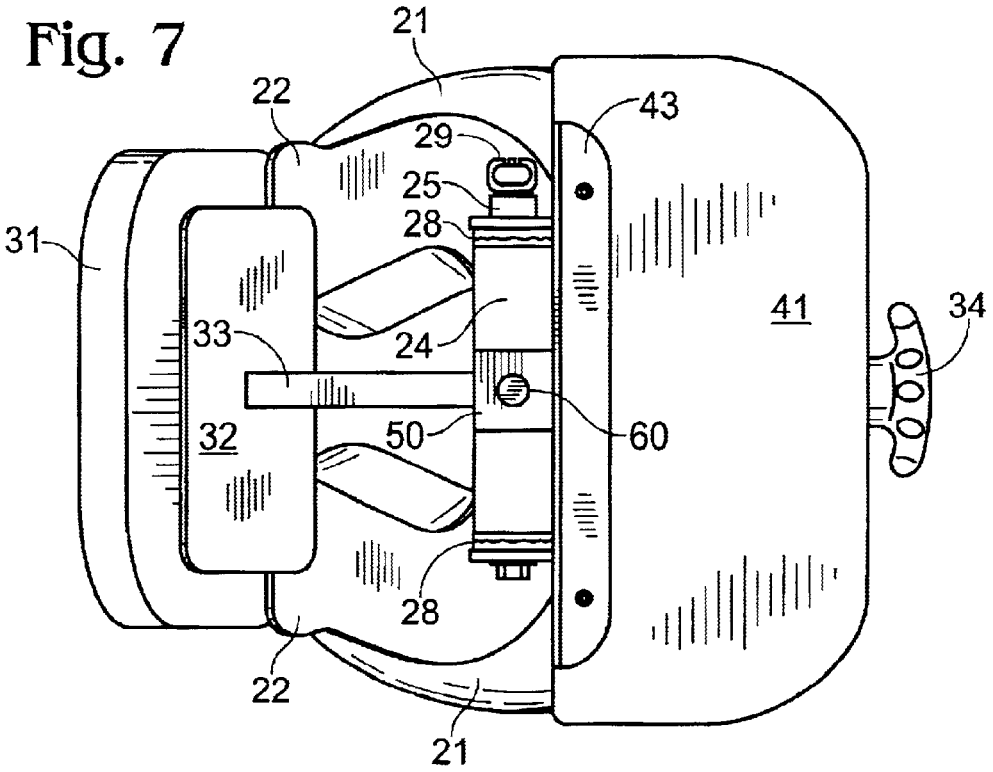
FIG. 7 is a bottom plan view thereof.

Face pad 21 is attached to a generally inverted U-shape plate member 22. U-shaped plate member 22 has substantially the same peripheral shape as face pad 21, but smaller in size, as best seen in FIG. 4.

A pair of substantially parallel pivot rails 23 extend downwardly from the underside of plate member 22, substantially perpendicular thereto.

A U-shaped yoke 24 having a pair of vertical arms extending upwardly from a base that is attached to the upper end of support post 50. A pivot rod 25 extends between the upper ends of the vertical arms of yoke 24 with the ends of the pivot rod 25 extending beyond the outer surfaces of each of the arms of yoke 24, as best seen in FIG. 4.

A pair of rear cantilever arms 26 are each pivotally attached at their inner ends to pivot rod 24 adjacent the inside of the vertical arms of yoke 24, and pivotally attached at their outer ends to pivot rails 23 of plate member 22.

A pair of front cantilever arms 27 are each pivotally attached at their inner ends to pivot rod 24 adjacent the outside of the vertical arms of yoke 24, and pivotally attached at their outer ends to pivot rails 23 of plate member 22.

A pair of disc-shaped meshing locking members 28 are located between the outside of each of the vertical arms of yoke 24 and the inside of each of the front cantilever arms 27, as best seen in FIG. 4.

Locking handle 29 is attached to the left outer end of pivot rod 25, and is adapted to release engagement of each pair of meshing locking members 28 upon twisting handle 29 counterclockwise and to engage each pair of meshing locking members 28 upon twisting handle 29 clockwise. Releasing engagement of the meshing lock members 28 allows the major plane of pad 21 to be adjusted to an angle between a substantially vertical position and a substantially horizontal position.

Chest support subassembly 30 includes a chest pad 31. Chest pad 31 is formed of a foamed plastic or rubber core with an impervious, cleanable plastic cover. The underside of chest pad 31 is attached to a chest pad support plate 32. Chest pad support plate 32 is attached to the inner end of an adjustable chest pad support rod 33.

Chest pad support rod 33 preferably extends through an opening in support post 50 and has a knob 34 on the outer end thereof; however, chest pad support rod 33 can extend through a channel member attached to one side of post 50.

A locking arm 35 is attached to the outer end of a threaded bolt-like rod member 36 which threadably meshes with a nut-like plate member 37 attached to the outside of support post 50. Rod member 36 passes through an opening in the wall of support post 50. Upon turning locking arm 35 clockwise, the inner end of rod member 36 engages the outer surface of chest pad support rod 33 to prevent its movement. Upon turning locking arm 35 counterclockwise, the inner end of bolt-like member 36 disengages the outer surface of chest pad support rod 33, allowing it to be moved horizontally back and forth by use of knob 34 in order that chest pad 34 may be positioned where desired.

Arm support subassembly 40 includes an arm pad 41. Arm pad 41 is formed of a foamed plastic or rubber core with an impervious, cleanable plastic cover. The underside of arm pad 41 is attached to a substantially horizontal arm pad support plate 42. The horizontal leg of "angle iron" 43 is attached to the inner end of arm pad support plate 42 and the middle of the vertical leg of angle iron 43 is attached to support post 50 between the mid-portion and lower end of support post 50. "Angle iron" 43 may be made of light weight material, such as aluminum.

Support post 50 is preferably a metal tube member. Support post 50 preferably has a square cross-section; however, its cross-section may be other shapes.

Support leg 60 is attached to and extends downwardly from the lower end of support post 50. Where support post 50 is hollow, support leg 60 can extend into the lower portion of support post 50. Support leg 60 and support post 50 preferably have a common longitudinal axis. Support leg 60 is preferably a cylindrical metal rod, and can be solid or hollow. Support leg 60 is preferably adapted to be received by those conventional clamp members (not shown) commonly attached to the sides and/or ends of an operating or examination table that are designed to receive an intravenous (IV) support rod. Such IV clamps are well known in the art. Alternatively, support leg 60 could be clamped or otherwise attached to a movable base member which could be placed in front of a patient sitting on a bed, table or chair.

In operation, a patient is seated on the edge of an operation or examination table adjacent an IV clamp. Support leg 60 of the epidural stabilization device 10 is then placed into the clamp and locked into place with the face support 20 and chest support 30 being positioned approximately adjacent the head and chest, respectively, of the patient. Face support 20 and chest support 30 are then adjusted to the most comfortable position for the patient. The patient then places his or her face onto the face pad 21 with his or her chest pressing against chest pad 31. The patient's arms rest against arm pad 41. In such a position, the attending physician can easily access the patient's back for the epidural procedure, and epidural stabilization device 10 keeps the patient comfortably motionless during the procedure.

Whenever the directional terms "upper", "lower", "front", "rear", "inner", "outer", "left", "right", "top", "bottom", "downwardly", "upwardly", "inside", "outside", "vertical", "horizontal", and "underside" have been used herein, they have been used consistent with the directions used in the "Brief Description of the Drawings" section of this application.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An epidural stabilization device comprising:

a face cradle subassembly including a face pad having a major plane, said face pad adapted to be adjustable between a position where its major plane is substantially vertical and a position where its major plane is substantially horizontal, said face pad being attached to a plate having a pair of parallel pivot rails extending substantially perpendicularly downwardly from said plate, said pivot rails having front and rear ends;

a chest support subassembly including a chest pad;

an arm support subassembly including an arm pad;

a support post having upper and lower ends, a mid-portion and inner and outer sides, said face cradle subassembly being attached to the upper end of said post, said chest support subassembly being adjustably attached to a mid-portion of said support post, said arm support subassembly being attached to a portion of said support post between its mid-portion and its lower end;

a support leg extending downwardly from the lower end of said support post;

a yoke attached to the upper end of said support post, said yoke having substantially parallel arms extending upwardly, each of said arms having an inner and outer side;

a pivot rod extending between said arms of said yoke, said pivot rod having first and second ends which extend beyond the outer sides of said arms of said yoke;

a pair of rear cantilever arms having inner and outer ends, said inner ends of said rear cantilever arms being pivotally attached to said pivot rod adjacent the inner sides of each of said arms of said yoke, said outer ends of said rear cantilever arms being pivotally attached to said pivot rails adjacent the rear ends thereof;

a pair of front cantilever arms having inner and outer ends, said inner ends of said front cantilever arms being pivotally attached to said pivot rod adjacent the outer sides of each of said arms of said yoke, said outer ends of said front cantilever arms being pivotally attached to said pivot rails adjacent the front ends thereof; and means for releasably locking said front and rear cantilever arms against pivotal movement about said pivot rod.

2. An epidural stabilization device comprising:

a face cradle subassembly including a face pad having a major plane, said face pad adapted to be adjustable between a position where its major plane is substantially vertical and a position where its major plane is substantially horizontal;

a chest support subassembly including a chest pad, said chest pad having a lower surface attached to a chest pad support plate, said chest pad support plate being attached to an adjustable chest pad support rod at its inner end, said adjustable chest pad support rod extending substantially horizontally through an opening in said support post, said adjustable chest pad support rod being adapted to slide back and forth through said opening in said support post, and means for releasably locking said adjustable chest pad support rod against movement;

an arm support subassembly including an arm pad;

a support post having upper and lower ends, a mid-portion and inner and outer sides, said face cradle subassembly being attached to the upper end of said post, said chest support subassembly being adjustably attached to a mid-portion of said support post, said arm support subassembly being attached to a portion of said support post between its mid-portion and its lower end; and a support leg extending downwardly from the lower end of said support post.

* * * * *